US008342909B2

(12) United States Patent
Lemaire et al.

(10) Patent No.: US 8,342,909 B2
(45) Date of Patent: Jan. 1, 2013

(54) DEVICE FOR MACHINING OPHTHALMIC LENSES, THE DEVICE HAVING A PLURALITY OF MACHINING TOOLS PLACED ON A SWIVEL MODULE

(75) Inventors: Cédric Lemaire, Charenton-le-Pont (FR); Tony Michel, Charenton-le-Pont (FR); Gaël Mazoyer, Charenton-le-Pont (FR); André Menant, Cap d'Ail (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 873 days.

(21) Appl. No.: 12/444,970

(22) PCT Filed: Oct. 9, 2007

(86) PCT No.: PCT/FR2007/001642

§ 371 (c)(1),
(2), (4) Date: Jun. 12, 2009

(87) PCT Pub. No.: WO2008/043910

PCT Pub. Date: Apr. 17, 2008

(65) Prior Publication Data

US 2010/0093265 A1 Apr. 15, 2010

(30) Foreign Application Priority Data

Oct. 10, 2006 (FR) ..... 06 08864

(51) Int. Cl.
*B24B 49/00* (2006.01)

(52) U.S. Cl. ..... 451/11; 451/65; 451/71; 451/255; 451/256

(58) Field of Classification Search ..... 451/10, 451/11, 42, 43, 65, 67, 71, 246, 255, 256, 451/398; 408/236, 237; 409/335; 29/26 A, 29/27 C See application file for complete search history.

(56) References Cited

U.S. PATENT DOCUMENTS

| | | | | |
|---|---|---|---|---|
| 5,605,498 | A * | 2/1997 | Nauche | 451/240 |
| 6,383,061 | B1 * | 5/2002 | Mandler | 451/43 |
| 7,803,035 | B2 * | 9/2010 | Nauche et al. | 451/5 |
| 7,975,355 | B2 * | 7/2011 | Nauche et al. | 29/26 A |

FOREIGN PATENT DOCUMENTS

| | | |
|---|---|---|
| FR | 2614227 | 10/1988 |
| FR | 2852878 | 10/2004 |
| FR | 2874526 | 3/2006 |
| WO | 2006042917 | 4/2006 |

OTHER PUBLICATIONS

International Search Report dated Mar. 3, 2008, in PCT application.

* cited by examiner

*Primary Examiner* — Eileen P. Morgan
(74) *Attorney, Agent, or Firm* — Young & Thompson

(57) ABSTRACT

A device (1) for machining an ophthalmic lens includes a support for the ophthalmic lens and for driving it in rotation about a blocking axis (A1), a machining module (35) that can be swiveled relative to the support and driving the lens in rotation and that is suitable for pivoting about a swivel axis that is not parallel to the blocking axis of the lens, and at least one drill tool mounted to rotate on the machining module about a first axis of rotation. The machining device includes at least one other machining tool mounted to rotate on the machining module about another axis of rotation that is distinct from the first axis of rotation and that is stationary relative to the first axis of rotation.

20 Claims, 5 Drawing Sheets

Fig.6
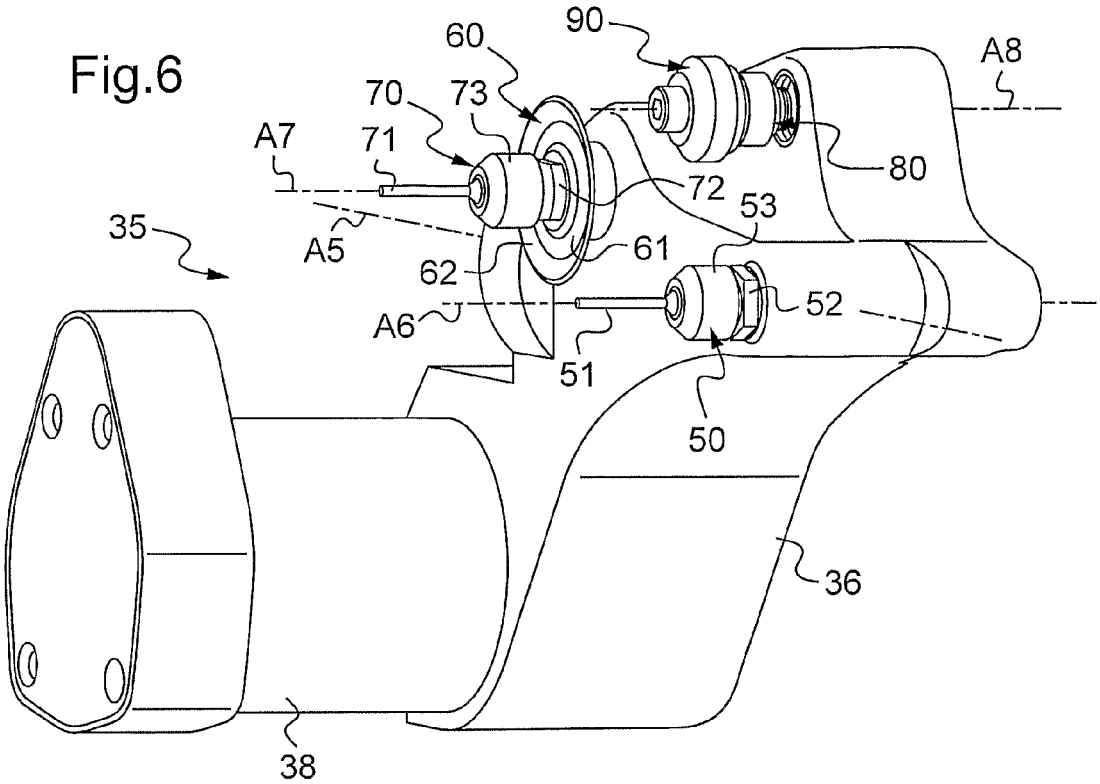
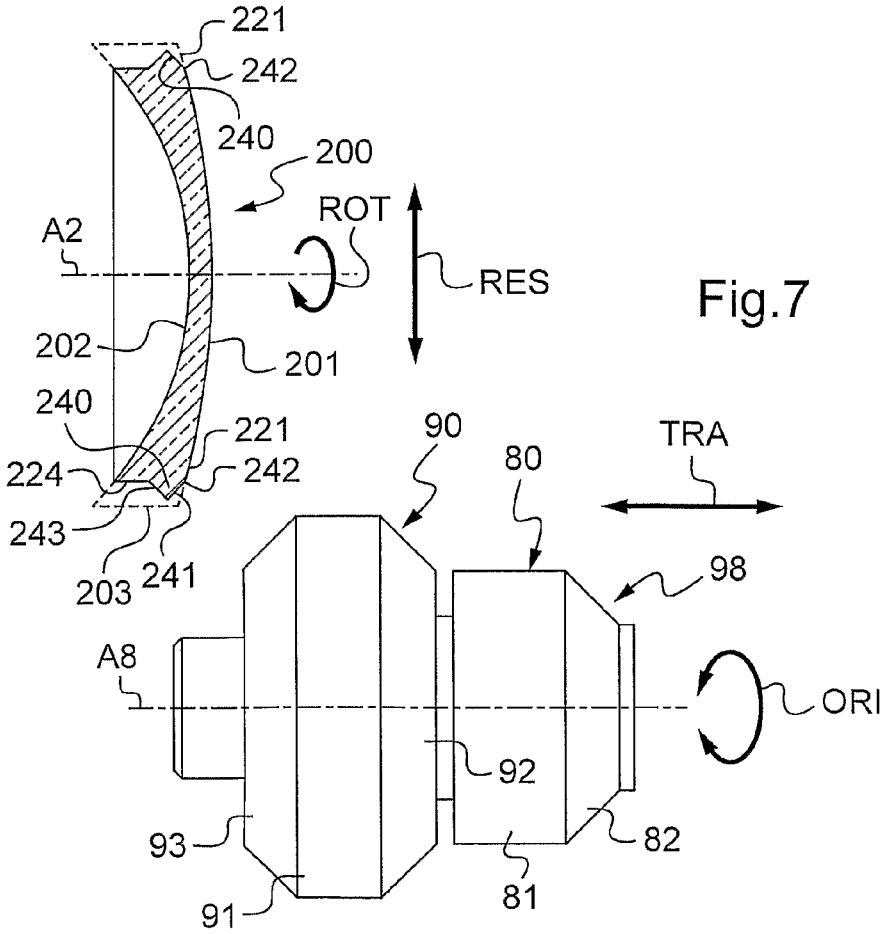
Fig.7

DEVICE FOR MACHINING OPHTHALMIC LENSES, THE DEVICE HAVING A PLURALITY OF MACHINING TOOLS PLACED ON A SWIVEL MODULE

TECHNICAL FIELD TO WHICH THE INVENTION RELATES

The present invention relates in general to the field of eyeglasses, and more particularly to mounting ophthalmic lenses of a pair of correcting eyeglasses on a frame thereof.

More particularly, the invention relates to a device for machining an ophthalmic lens, the device comprising means for supporting the ophthalmic lens and for driving it in rotation about a blocking axis, a machining module that can be swiveled relative to the means for supporting and driving the lens in rotation and that is suitable for pivoting about a swivel axis that is not parallel to the blocking axis of the lens, and at least one drill tool mounted to rotate on said machining module about a first axis of rotation.

TECHNOLOGICAL BACKGROUND

The technical portion of the profession of an optician consists in mounting a pair of ophthalmic lenses in a frame selected by a wearer. Mounting comprises three main operations:

- acquiring the shape of the bezel of each of the two rims of the eyeglass frame selected by the future wearer, i.e. the shape of the longitudinal strand of the corresponding bezel, generally corresponding to the bottom of the groove going round the inside of the rim of the frame;
- centering each lens, which consists in determining the position each lens is to occupy in the frame so as to be appropriately centered facing the pupil of the wearer's eye so that the lens acts appropriately in performing the optical function for which it was designed; and
- machining each lens, which consists in cutting its outline to the desired shape, while taking account of defined centering parameters so that it can be fastened to the corresponding eyeglass frame.

The present invention relates to the third operation of machining ophthalmic lenses. This is performed by means of an appropriate machining device.

In order to cut the outline of the lens to the desired shape, various machining operations are performed one after another on the lens. After an operation of edging the lens to shape its periphery, various finishing operations are performed on the edge face of the lens.

In particular, if the lens is to be engaged in a rimmed eyeglass frame, finishing includes a beveling operation that consists in making a bevel on the edge face of the lens, i.e. a peripheral ridge that is shaped to have a generally V-shaped section. The bevel is designed to engage in the bezel of the corresponding rim of the frame for the purpose of fastening the lens. If the lens is to be mounted in a drilled eyeglass frame, finishing includes a drilling operation that consists in making bores or notches in the lens for having the eyeglass frame fastened thereto. If the lens is to be mounted in a half-rimmed eyeglass frame, finishing includes a grooving operation that consists in forming a groove in the edge face of the lens, which groove is suitable for receiving a string for attaching the lens to the frame.

Document EP 1 807 244 discloses a device for machining ophthalmic lenses, which device is suitable for implementing all of the above machining operations with the help of various machining tools. That machining device includes shafts for supporting the ophthalmic lens, a grindwheel for shaping and beveling the lens, and a finishing module.

To enable the lens to be moved towards or away from the shaping and beveling grindwheel, the clamping shafts are carried by a rocker that can pivot about an axis parallel to the lens support axis.

To enable the lens to move towards or away from the finishing module, the finishing module includes a support that is pivotally movable about an axis parallel to the lens support axis.

To perform additional machining on the lens (drilling, grooving, polishing, and finishing), the support of the finishing module carries a set of finishing wheels that are mounted to rotate about an axis of rotation, and also a drill that is movable in pivoting on the support about an axis that extends transversely relative to the lens support axis. The drill carries a drill bit that is mounted to rotate about a second axis of rotation that can be oriented relative to the lens because the drill is free to move appropriately.

The main drawback of such a machining tool is that the set of wheels comprises numerous tools that are stacked one next to the other so that the set of wheels is cantilevered out over a long length. While the lens is being machined, bending forces are applied to the set of wheels, thereby deforming it and causing the machining of the ophthalmic lens to become inaccurate.

Furthermore, because of its length, the set of wheels occupies a considerable amount of space and, because of the way the tools are stacked together, it requires time-consuming maintenance. In particular, in order to change a single one of the tools in the stack, it is necessary to begin by removing all of the tools that precede it in the stacking order.

Furthermore, the set of wheels is driven in rotation by a common motor, which means that it is necessary to modify the speed of rotation of the motor depending on which tool is being used. The motor is thus caused to operate over a range of speeds of rotation that correspond to powers that are far removed from its nominal power curve. As a result, it is necessary to use a motor that is powerful, and that is therefore expensive and bulky.

Furthermore, since the drill can move relative to the finishing module, it is essential to provide a motor for driving the drill bit in rotation and a motor for driving the set of wheels in rotation. In addition to its high manufacturing cost, such an architecture gives the finishing module size and weight that are considerable.

Finally, only the drill bit can be oriented relative to the lens, which means in particular that it is not possible to modify the orientation of the groove in the edge face of the lens.

Document FR 2 614 227 discloses a machining device in which provision is made to group together various machining tools on a common module, the tools having axes of rotation that are distinct and parallel to the axis of the lens support. In order to select each tool (by placing the selected tool so that it faces the lens for machining), that module is mounted to pivot about an axis that is parallel to said axes of rotation. Nevertheless, that device does not have a drill tool. The above-mentioned pivoting also prevents the machining tools from being inclined relative to the lens, e.g. for the purpose of modifying the orientation of the groove in the edge face of the lens.

Even assuming it might be envisaged to combine the teaching of the two above-mentioned documents, that would not lead to a device that is fully satisfactory and functional. Supposing it were envisaged to add an additional tool against the drill of the machining device described in document EP 1 807 244, e.g. a grooving tool, even though no document in the prior art proposes that expressly, there would be remain a problem of providing motor drive for those two tools. The use of two motors would lead to problems of motorization and of weight. The use of a single motor would mean that advantage could not be taken of the full power of the motor when drilling or when grooving the lens. It would therefore be necessary to use a motor that is powerful and thus expensive and bulky. In addition, placing those two tools beside each other would lead to interference appearing between the tools and the lens support shafts, which would make it difficult for the drill bit to have access to the central portion of the lens. Because of such interference, it would then be impossible, or at least difficult, to drill lenses close to their geometrical centers, and that can be problematic with lenses of small dimensions.

OBJECT OF THE INVENTION

The present invention proposes a novel machining device that is more compact, that is easier to maintain, and that provides improved accuracy, enabling lenses to be drilled close to their support axes and in which at least two tools on distinct axes can be oriented relative to the lens.

More particularly, the invention provides a machining device as defined in the introduction, in which there are provided firstly at least one grooving and/or grinding tool mounted to rotate on said machining module about a second axis of rotation distinct from and stationary relative to the first axis of rotation, and secondly a motor and gearbox assembly having a single motor and adapted to drive said grooving and/or grinding tool and said drill tool at different speeds of rotation.

The term "drill tool" is used to mean any type of tool suitable for drilling a hole in the ophthalmic lens. In particular, the drill tool may comprise a drill bit made of a material suitable for drilling lenses made of glass, of polycarbonate, or of plastics material. The term "grooving and/or grinding tool" is used to mean any type of tool suitable for forming a groove in the edge face of a lens and/or for machining the edge face of the lens. In particular, the grooving tool may conventionally comprise a wheel in the form of a collar. In a variant it may include a small-diameter cutter that, when used orthogonally relative to the edge face of the lens, enables a groove to be machined along the edge face of the lens by means of the free end of the cutter. Furthermore, the grinding tool may comprise any type of grindwheel or wheel, cutter, or knife, suitable for shaping and/or beveling and/or polishing the edge face of the lens. In particular, a cutter used orthogonally relative to the edge face of the lens can also be used for shaping and/or beveling the edge face of the lens.

The tools for machining the ophthalmic lens are thus distributed over the machining module, singly or in groups, on distinct axes of rotation. The length of each tool or group of tools is thus short, so that bending forces give rise to little inaccuracy in machining. Furthermore, the overall size of the machining device is reduced. The fact that the machining tools are placed on a swivel-mounted machining module enables these tools to be inclined while they are machining the lens, thereby enabling them to be adapted accurately to the shape and to the configuration of the lens relative to the device. Finally, placing the drill tool on an axis of rotation that is distinct from the axis of the grooving and/or grinding tool enables the drill tool to present an overall diameter that is small. As a result, it can be moved close to the lens support means so as to be able to drill the lens at a very short distance from the support axis of the lens.

Furthermore, a single motor housed in the machining module serves to rotate each of the machining tools of the module at a specific speed of rotation that is the nominal speed of rotation for which the tool is designed and that corresponds to the type of machining it is to perform.

Each machining tool is made of its own material and presents a diameter that is different from the diameters of the other tools, and is adapted to perform machining of a type that differs from the machining of the other tool. The reduction ratio specific to each tool or group of machining tools (which may be greater than or less than 1) enables the speed of rotation of the tool to be adapted to the machining it is to perform. This reduction ratio relative to the speed of the motor also makes it possible to make best use of the power of the motor, and as a result to use a motor of limited power (and therefore inexpensive and compact).

According to a first advantageous characteristic of the invention, the distance between said swivel axis and said first axis of rotation is less than 40 millimeters.

Consequently, when the machining module pivots about its swivel axis, the end of the drill tool moves over a short stroke, which stroke would be much greater if its axis of rotation were remote from the swivel axis. This short stroke thus enables the end of the drill bit to be positioned quickly relative to the lens. Positioning the drill bit thus requires little space, such that the overall size of the machining device is reduced. Finally, because of this small stroke, the motors serving to place the drill bit facing the lens rotate over a smaller stroke, such that the motors lose fewer steps (loss of reference) and drilling accuracy is increased.

According to another advantageous characteristic of the invention, the machining device includes a shaping grindwheel mounted to rotate about a transfer axis, the direction of the blocking axis is stationary relative to the transfer axis, and the direction of the machining module is variable relative to the transfer axis.

Advantageously, the axes of rotation of the grooving and/or grinding tool and of the drill tool of the machining module are mutually parallel.

According to another advantageous characteristic of the invention, the machining module is free to move transversely relative to the blocking axis, and is free to move axially in translation along a transfer axis parallel to said blocking axis relative to the means for supporting the lens and driving it in rotation.

Advantageously, the machining device includes a support on which said machining module is mounted to pivot about the swivel axis and is adapted to move in translation along said transfer axis relative to the means for supporting the lens and driving it in rotation, and to pivot about said transfer axis to provide the machining module with its freedoms to move transversely and axially.

According to another advantageous characteristic of the invention, the machining device includes actuator means for actuating the machining module, which actuator means are arranged to adjust the orientation of the machining module about the swivel axis by making use of its freedom to move axially, and are engageable and disengageable by making use of its freedom to move transversely.

The machining module does not have its own electromechanical actuator means for adjusting its orientation. For this purpose it is provided solely with mechanical means such as a lever adapted to co-operate with a stationary portion of the device. This co-operation can then place when the support of the machining module takes up a predetermined engagement position making use of its own freedoms to move transversely and axially.

Preferably, the drill tool is the only machining tool mounted to rotate about the first axis of rotation and is situated on an edge of the machining module in such a manner that there exists at least one position of the machining module in which the spacing between the first axis of rotation and the blocking axis is less than the sum of the radius of the grooving and/or grinding tool plus the radius of the means for supporting the lens and for driving it in rotation.

This distance is thus less than the sum of the smallest radius of the grooving and grinding tools plus the radius of the shafts for supporting the lens and for driving it in rotation. It would therefore not be possible to bring the drill bit so close to the center of the lens if the drill bit were mounted on an axis of rotation together with one of the grooving and grinding tools.

Advantageously:

- the machining module includes no more than two machining tools mounted to rotate about any one axis of rotation;
- the machining module includes a grooving wheel and a milling tool of diameter smaller than one centimeter mounted to rotate about a common axis of rotation; and
- the machining module includes a rigid finishing wheel and a flexible polishing wheel mounted to rotate about a common axis of rotation.

DETAILED DESCRIPTION OF AN EMBODIMENT

The following description with reference to the accompanying drawings given by way of non-limiting example shows clearly what the invention consists in and how it can be reduced to practice.

In the accompanying drawings:

FIG. 6 is a perspective view of the FIG. 4 machining module seen from another angle;

FIG. 7 is a plan view of a finishing and polishing module of the machining module of FIG. 4.

Figure 1:
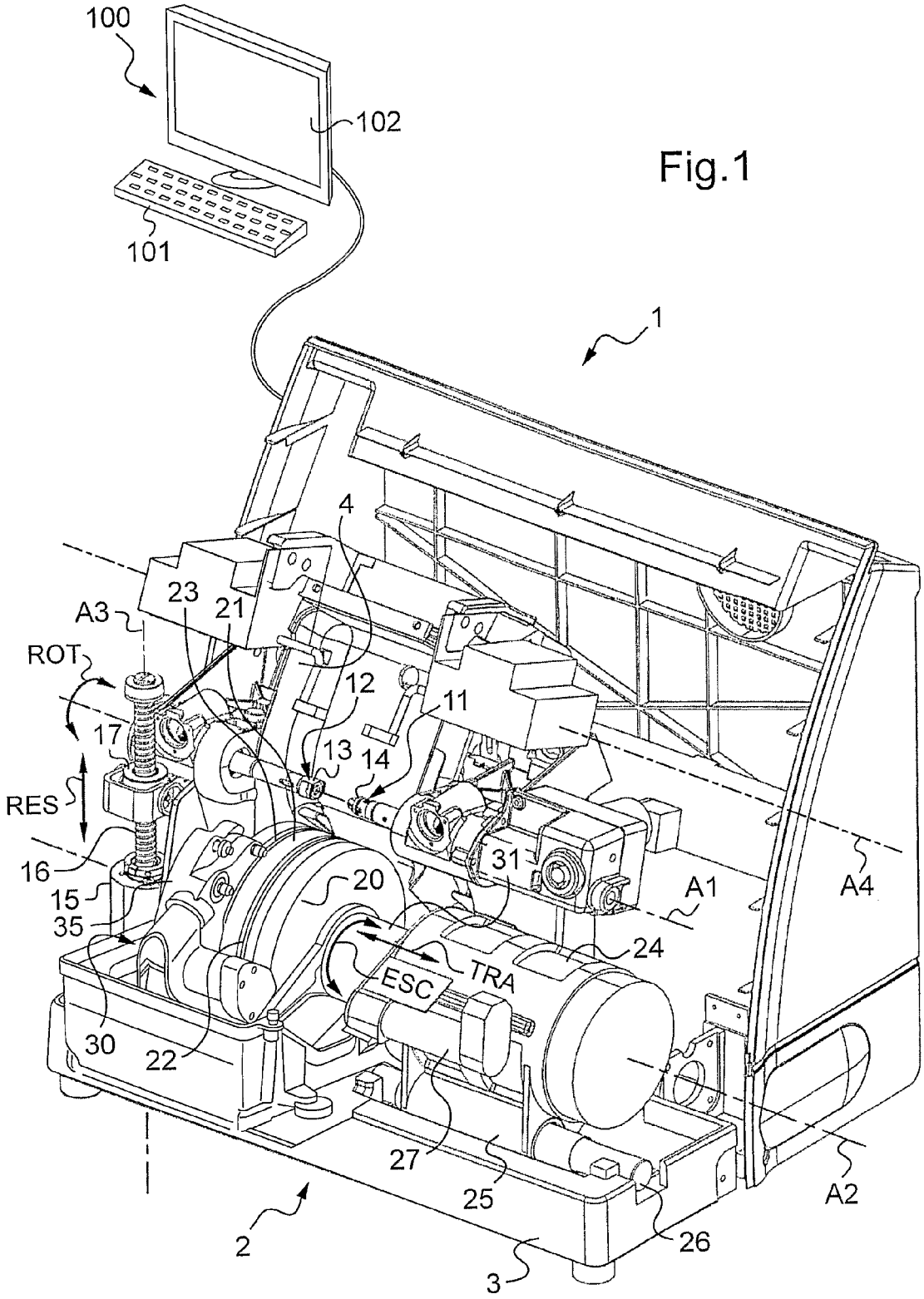
FIG. 1 is an overall perspective view of a machining device of the invention.

FIG. 1 shows a machining device 1 for machining an ophthalmic lens, the device comprising an automatic grinder 2, commonly said to be numerically-controlled, and an electronic and computer device 100. The electronic and computer device 100 includes data acquisition means 101, here constituted by a keyboard, information means 102 constituted by a screen, and driver means suitable for driving the various degrees of freedom of the grinder 2.

Specifically, the grinder 2 includes a rocker 4 mounted to pivot freely about a tilt axis A4 extending horizontally on a frame 3.

To hold the ophthalmic lens for machining stationary and to drive it in rotation, the rocker 4 is fitted with support and rotary drive means 11, 12 constituted by two shafts of small diameter (approximately equal to 14 millimeters) suitable for holding the lens like a vice so as to block it. These two shafts 11, 12 are in alignment with each other on a blocking axis A1 that is parallel to the tilt axis A4. The two shafts 11, 12 are driven in rotation synchronously by a motor (not shown), via a common drive mechanism (not shown) on board the rocker 4. The common mechanism for delivering synchronous rotary drive is of common type and is itself known.

The rotation ROT of the shafts 11, 12 is driven under the control of the electronic and computer device 100.

Each of the shafts 11, 12 possesses a free end facing the other shaft and fitted with a blocking chuck 13, 14. The two blocking chucks 13, 14 are generally bodies of revolution about the blocking axis A1, each presenting an application base arranged to bear against the corresponding optical face of the ophthalmic lens for machining.

The shaft 11 is movable in translation along the blocking axis A1 in register with the other shaft 12 so as to enable the lens to be clamped in axial compression between the two blocking chucks 13, 14. This movement in axial translation of the shaft 11 is controlled by a drive motor acting via an actuator mechanism (not shown) under the control of the electronic and computer device 100. The other shaft 12 is stationary in translation along the blocking axis A1.

The machining device 1 also includes a set of grindwheels for edging and possibly also for shaping the lens. This set of grindwheels comprises a shaping and beveling grindwheel 20 that is constrained to rotate with a transfer axis A2 parallel to the blocking axis A1 and that is itself also driven in rotation by a specific motor. This shaping and beveling grindwheel 20 presents a peripheral edge face 21 that is generally cylindrical about the transfer axis A2 and that includes two V-profile beveling grooves 22 and 23.

The set of grindwheels is fastened on a common shaft of axis A2 serving to drive the set in rotation during the operation of edging and beveling the ophthalmic lens. This common shaft, which is not visible in the figures, is driven in rotation by an electric motor 24 under the control of the electronic and computer device 100.

The set of grindwheels is also movable axially in translation along the axis A2 and is moved in this translation by a controlled motor. Specifically, the assembly comprising the set of grindwheels, its shaft, and its motor is carried by a carriage 25 that is itself mounted on slides 26 secured to the frame 3 to slide along the transfer axis A2. This freedom of the carriage 25 to move axially is referred to as "transfer" and is referenced TRA in FIG. 1. This transfer is controlled by the electronic and computer device 100.

In order to enable the distance between the transfer axis A2 of the shaping and beveling grindwheels 20 relating to the blocking axis A1 to be adjusted dynamically, use is made of the ability of the rocker 4 to pivot about the tilt axis A4. This pivoting gives rise to the ophthalmic lens clamped between the shafts 11 and 12 moving, here substantially vertically, either towards or away from the beveling grindwheel 20. This freedom of the lens to move that enables the desired beveling shape as programmed in the electronic and computer device 100 to be reproduced, is referred to as "reproduction" and is referenced RES in FIG. 1.

This freedom of movement is used with the help of a screw and nut system. The system comprises firstly a reproduction motor 15 secured to the frame 3 and rotating a threaded rod 16 on a reproduction axis A3 perpendicular to the blocking axis A1, and secondly a nut 17 that co-operates with the threaded rod 16 and that is secured to the rocker 4. Rotation of the reproduction motor 15 thus enables the nut 17 to be moved up or down along the threaded rod 16 so as to modify the distance between the transfer axis A2 of the shaping and beveling grindwheel 20 and the blocking axis A1.

Figure 8:
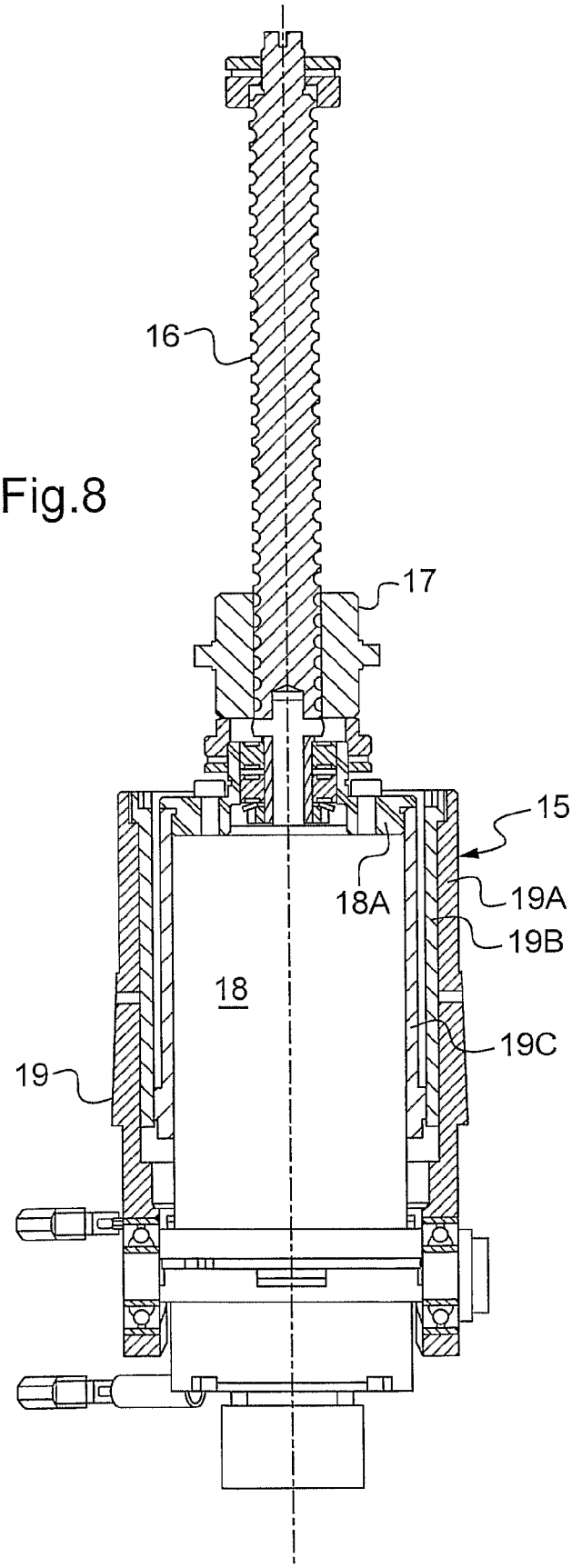
FIG. 8 is a section view of the reproduction motor of the FIG. 1 machining device.

More precisely, as shown in FIG. 8, the reproduction motor 15 conventionally comprises a rotor and stator assembly 18 housed inside a cylindrical cover 19. The reproduction motor 15 is designed to be insensitive to temperature variations.

For this purpose, the rotor and stator assembly is fastened to an end plate 18A, itself connected to the threaded rod 16. The cylindrical cover 19 comprises three coaxial cylindrical bells that are nested one inside another. The outer cylindrical bell 19A is fastened at its bottom end to the frame 3 of the grinder 2. The inner cylindrical bell 19C is fastened at its top end to the end plate 18A. Finally, the intermediate cylindrical bell 19B is fastened at its top end to the top end of the outer cylindrical bell 19A and at its bottom end to the bottom end of the inner cylindrical bell 19C.

Each of these three cylindrical bells is made of a material that is different from the material of the other bells, each material having its own coefficient of thermal expansion. Thus, when the rotor and stator assembly 18 heats up, the three bells expand through mutually different lengths. The threaded rod 16, which is made to steel, also lengthens. The materials and the dimensions of the three bells are selected in such a manner that the expansions (including the expansion of the mean working length of the rod) compensate so as to avoid the end plate 18A and the threaded rod 16 giving rise to unwanted thermal dispersions, which could lead to errors in the machining of ophthalmic lenses. When calculating the dimensions and the materials of the three bells, account is taken not only of the expansions of the bells themselves, but also the expansion of a mean working length of the threaded rod 16 (e.g. about 100 millimeters) corresponding to the mean position of the nut 17 during the final stage of shaping lenses.

In order to machine the ophthalmic lens to have a given outline, it thus suffices firstly to move the nut 17 accordingly along the threaded rod 16 under the control of the reproduction motor 15 so as to control reproduction movement, and secondly to cause the support shafts 11 and 12 to pivot correspondingly about the blocking axis A1, in practice under the control of the motor that controls them. The transverse reproduction movement RES of the rocker 4 and the rotary movement ROC of the lens-holding shafts 11, 12 are controlled in coordinated manner by the electronic and computer system 100, which is suitably programmed for this purpose, so that all of the points on the outline of the ophthalmic lens are brought in succession to the appropriate diameter.

The grinder shown in FIG. 1 also includes a machining arm 30 that is provided firstly with a machining module 35 that carries additional machining tools 50, 60, 70, 80, 90 (FIG. 6) for shaping and finishing the ophthalmic lens, and secondly a support 31 that connects the machining module 35 to the frame 3 of the grinder 2.

Figure 2:
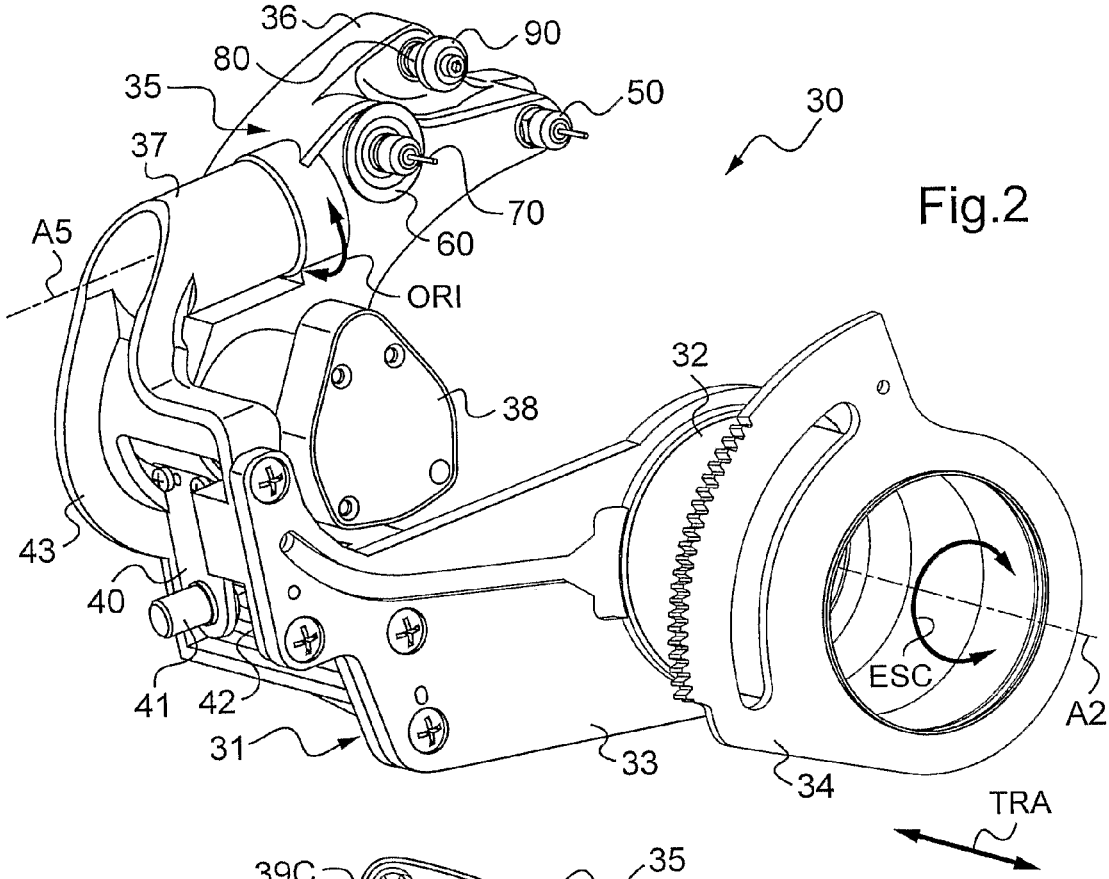
FIG. 2 is a detail perspective view of a machining arm of the FIG. 1 machining device.

As shown in FIGS. 1 and 2, the machining arm 30 presents a degree of freedom to move in a direction extending substantially transversely relative to the blocking axis A1 and the reproduction axis A3. This transverse freedom of movement is referred to as retraction and is referenced ESC. Specifically, retraction consists in pivoting the machining arm 30 about the transfer axis A2.

Because the machining arm 30 possesses freedom to move in transfer TRA and in retraction ESC, the machining module 35 presents an adjustable position that enables the additional machining tool to be moved towards or away from the lenses blocked by the shafts 11, 12 of the device.

Figure 3:
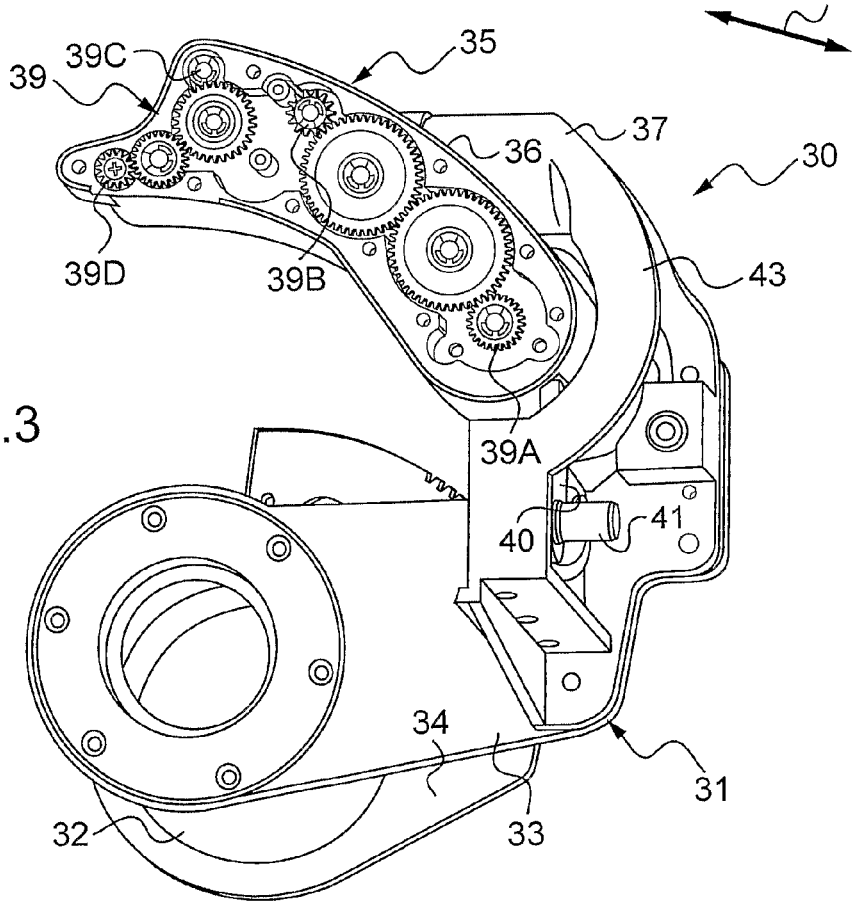
FIG. 3 is a perspective view of the FIG. 2 machining arm seen from another angle.

Concretely, as shown in FIGS. 2 and 3, the support 31 of the machining arm 30 is provided with a tubular sleeve 32 mounted on the carriage 25 to pivot about the transfer axis A2 and to move in translation with the carriage 25 along axis A2 (freedom to move in transfer TRA). In order to control its pivoting, the tubular sleeve 32 is provided at one of its ends with a wheel 34 having an angular sector carrying teeth and meshing with a gearwheel (not visible in the figures) fitted to the shaft of an electric motor 27 secured to the carriage 25.

The machining module 35 is connected to the tubular sleeve 32 of the support 31 by means of a lever 33 that is fastened to the other end of the tubular sleeve 32, and by means of a connection piece 43.

As shown more particularly in FIG. 2, the machining module 35 includes a box 36 extending lengthwise along a circular arc so as to match the shape of the shaping and beveling grindwheel 20 about which it pivots (retraction ESC).

The box 36 includes, halfway along, a shaft (not shown) that extends along a swivel axis A5 orthogonal to the transfer axis A2. Said shaft is inserted in a bushing 37 of complementary shape forming part of the connection piece 43. The shaft and the bushing thus form a pivot connection about the axis A5 enabling the machining module 35 to pivot relative to the connection piece 43. This freedom of the machining module 35 to swivel about the axis A5 is referenced ORI in FIGS. 2 and 4.

This freedom to move is braked continuously by brake means (not shown). These brake means are disposed inside the bushing 37 and/or the shaft inserted in the bushing. By way of example, they may be implemented in the form of a brake comprising firstly a piston housed in an axial bore in the shaft so as to be capable of sliding in said bore while being constrained to move in rotation with the shaft, and secondly a return spring urging the piston against the end of the bushing 37. The front face of the piston is provided with a friction surface that serves to block pivoting of the shaft in the bushing 37 by rubbing against the end wall of the bushing 37.

The braking that is obtained needs to be sufficient to withstand the torque that is generated during machining of the ophthalmic lens by any one of the additional machining tools 50, 60, 70, 80, 90 carried by the machining module 35.

In this example, the piston is not declutchable and it therefore brakes continuously. It is nevertheless possible to envisage providing controlled declutching means that serve to block pivoting of the machining module.

The box 36 of the machining module 35 carries the additional machining tools 50, 60, 70, 80, 90 in its end zone that is the closer to the lens support shafts 11, 12.

As shown more particularly in FIG. 6, the box 36 carries five tools organized in three groups, each group having one or two machining tools. Each group is adapted to turn about a corresponding axis of rotation A6, A7, or A8 that is distinct from the axes of rotation of the other groups of tools. These axes of rotation are mutually parallel in this example.

The first group located at the end of the box 36 comprises a single drill tool 50. The drill tool 50 conventionally comprises a drill bit 51 for drilling the ophthalmic lens, and held by a chuck 52 and a ring 53 for clamping the chuck 52 on the drill bit 51. The chuck 52 is adapted to revolve about an axis of rotation A6 that is orthogonal to the swivel axis A5. Depending on the orientation of the machining module 35 about the swivel axis 35, the axis of rotation A6 of the drill tool 50 may be parallel with the blocking axis A1 of the ophthalmic lens or it may be inclined relative thereto. Swiveling the machining module 35 thus enables the drill bit 51 to be inclined relative to the ophthalmic lens so as to enable it to be drilled along the desired axis.

In this example, the drill tool 50 is arranged on the machining module 35 in such a manner that its axis of rotation A6 is spaced apart from the swivel axis A5 by a distance of less than 40 millimeters, and preferably by a zero distance.

Consequently, when the machining module 35 pivots about its swivel axis A5, the end of the drill bit 51 describes a circular arc of small radius about the swivel axis A5. The machining tool is thus positioned relative to the lenses with a stroke for the drill bit that is small, such that positioning is fast and accurate.

Furthermore, the drill tool 50 is the only tool on its axis of rotation, while the chuck 52 and the clamping ring 53 present diameters that are small, of the order of 8 millimeters. In addition, the drill tool 50 is situated at the end of the machining module 35 so that the edge of the chuck is flush with the end of the machining module. In this way, when the machining module is brought close to the lens blocking shafts 11, 12, without contact being made between the drilling tool (or its chuck or clamping ring) and the shafts (or the lens blocking chuck), then the spacing between the axis of rotation A6 of the drilling tool and the blocking axis A1 of the lens is equal to about 11 millimeters.

Consequently, the drill tool 50 may be brought very close to the shafts 11, 12 for supporting and for rotating the lens, thereby enabling the lens to be drilled close to its blocking axis A1. It is thus possible to drill lenses of small dimensions.

A second group of machining tools comprises a stack of two distinct tools, namely a grooving wheel 60 and a milling wheel 70 of diameter smaller than 1 centimeter, e.g. equal to 5 millimeters. These two tools are adapted to rotate about a common axis of rotation A7.

The milling tool 70 conventionally comprises an elongate cutter 71 of small diameter that is adapted to pierce and then slice through the ophthalmic lens in its thickness direction in order to shape it to the desired outline. It is held by a chuck 72 and a ring 73 for clamping the chuck 72 onto the cutter 71.

Figure 4:
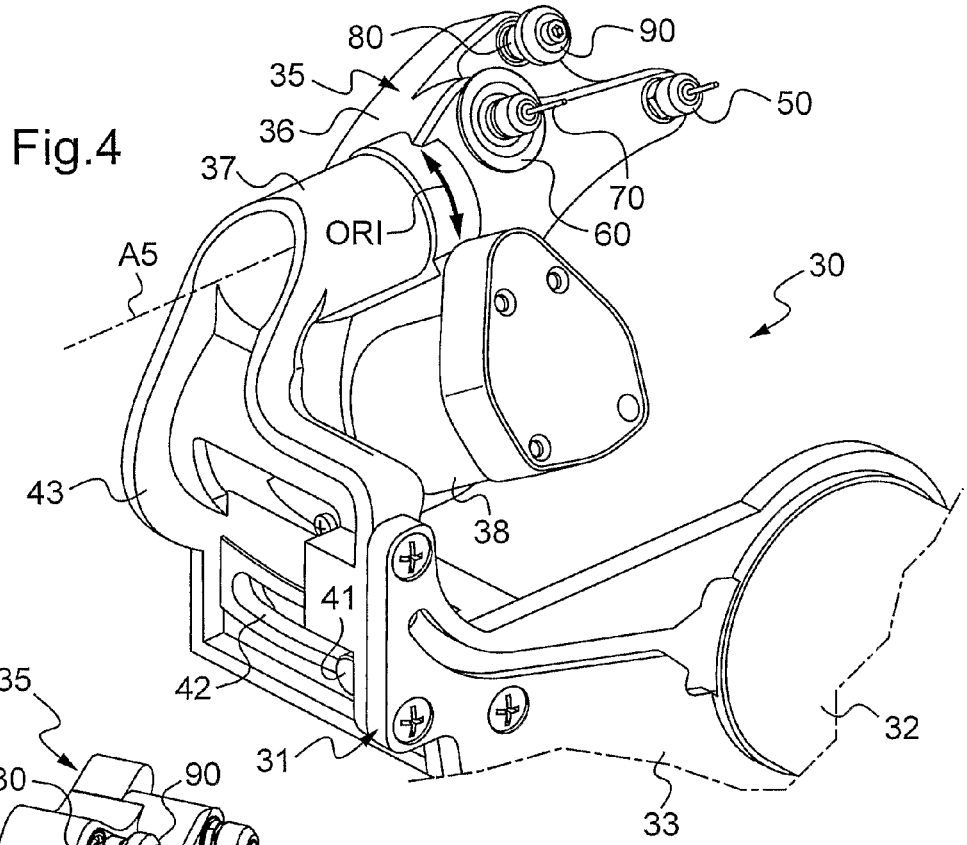
FIG. 4 is a perspective view of the FIG. 2 machining arm including a machining module shown in an inclined position.

As shown in FIG. 4, and as explained in greater detail below, the machining module 35 can pivot about the axis A5 between two extreme angular positions that are angularly spaced apart by a small angle (equal to about 30 degrees). In a variant of the invention that is not shown, provision could be made for these two extreme angular positions to be spaced apart angularly by an angle equal to about 90 degrees. Thus, the cutter 71 could be brought under the edge face of the lens for machining in a vertical direction parallel to the axis A3. Its free end could thus be brought into register with the edge face of the lens. This position for the cutter (radial relative to the axis of the lens) could thus make it possible to form a groove or an engagement ridge (bevel) along the edge face of the lens, by causing the lens to pivot about its axis. In another variant, provision could be made to arrange the cutter on the machining module 35 in such a manner that its axis of rotation A7 extends parallel to the swivel axis A5. This would enable the free end of the cutter to be used also for making a groove or an engagement ridge along the edge face of the lens.

The grooving wheel 60 is generally in the form of a disk having a central opening engaged on the chuck 72 of the milling and shaping tool 70. The wheel 60 is constrained to rotate with the chuck 72 and it presents two concentric portions of small thickness. The central portion 61 is in the form of a disk having two faces that extend orthogonally to the axis of rotation A7. The peripheral portion 62 extends the central portion 61 but presents a shape that is slightly conical. The outline of this tool is adapted to make a groove in the edge face of the ophthalmic lens.

Its two faces are shaped so as to deburr the edge of the outline of the rear face of the ophthalmic lens. For this purpose, these faces are made of or coated in a suitable material that presents appropriate hardness and grain. This deburring is commonly referred to as facetting. In the event of interference being detected between the rear edge of the lens and the eyeglass frame, this makes it possible to remove material from the lens by machining a spot of its rear edge. Such interference generally appears when the lens presents considerable thickness. Typically, two types of interference can arise. In a first type of interference, the side arms or "temples" of the frame come into abutment against the edge of the rear face of the lens in the temple zone, thus preventing them from being folded down fully. In a second type of interference, the nose pads of the frame come into abutment against the edge of the rear face of the lens in the vicinity of the nose, thereby preventing the lens from being mounted appropriately.

This deburring is conventionally performed by machining one or more facets in the rear face of the lens, on planes that are substantially orthogonal to the blocking axis A1. Since the peripheral portion 62 of the tool is conical, use is made of the freedom of movement in swiveling ORI to incline the tool so that it deburrs the lens in a vertical plane (orthogonal to the blocking axis A1).

A third group of machining tools 98 also comprises a stack of two distinct tools, namely a finishing wheel 80 and a polishing wheel 90. These two tools are adapted to rotate about a common axis of rotation A8. This axis A8 is disposed between the axes of rotation A6 and A7 of the other two groups of tools. The third group of machining tools 98 is set back relative to the other groups of tools so that the lens can be put into contact with each of the tools of the machining module 35 without any risk of interference with another tool of the module.

The axes of rotation A7 and A8 of the second and third groups of tools are also located at a short distance from the swivel axis A5 (a distance of less than 40 millimeters), so that pivoting the finishing module 35 causes each machining tool to move through a small stroke.

Each of the three groups of machining tools is mounted on a drive shaft that is guided in rotation by a smooth bearing located in the box 36 of the machining module 35.

As shown more particularly in FIGS. 2 and 3, all of the machining tools 50, 60, 70, 80, and 90 are driven in rotation by a motor and gearbox assembly 38, 39 that has a single electric motor 38. The motor 38 has an outlet shaft with a gear 39A fastened thereto. This gear meshes with other gears 39 of different diameters, thereby making it possible in particular to cause the various gears 39B, 39C, and 39D to rotate at different speeds, said gears being connected to the drive shafts for the groups of machining tools. The gears 39 of the motor and gearbox assembly 38, 30 are all housed in a housing 36 that is closed by a cover.

The gear ratios of the motor and gearbox assembly 38, 39 are designed so that when the motor is delivering its maximum power, each of the machining tools rotates at approximately its nominal operating speed (determined by the manufacturer of the tool as a function of its shape, of the material from which it is made, and of the type of machining it performs). The torque that each machining tool can develop when machining the lens is thus at its maximum relative to the power of the motor.

On this topic, it should be observed that since the two machining tools in a given group of tools are driven at the same speed of rotation, they are selected so as to present nominal speeds of operation that are close.

Figure 5:
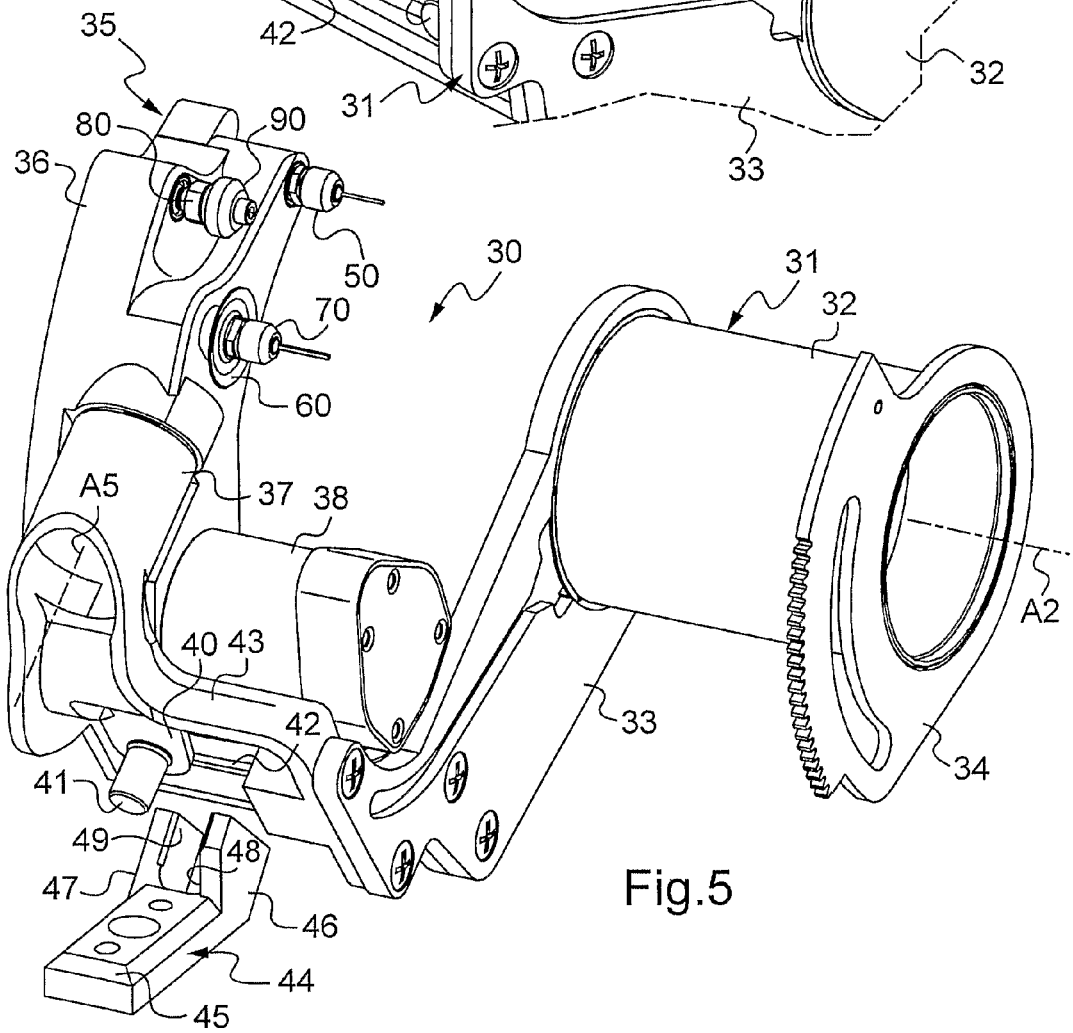
FIG. 5 is a perspective view of the retractable machining arm of FIG. 2 shown from another angle with means for adjusting the orientation of its machining module.

As shown more particularly in FIGS. 2, 4, and 5, the machining device 1 includes actuator means for actuating the machining module 35 so as to adjust its orientation about the swivel axis A5.

These actuator means are purely mechanical. They are designed to take advantage of the existing movement controls without it being necessary to have another electromechanical mechanism in the machining device 1 dedicated to performing this adjustment.

They comprise an adjustment tab 40 that is fastened to the housing 36 near its end remote from the machining tools 50, 60, 70, 80, and 90, and extending longitudinally on the circular arc formed by the housing, along an axis perpendicular to the swivel axis A5. The free end of this adjustment tab 40 is provided with a finger 41 of axis parallel to the swivel axis A5. This finger 41 is made up of two studs, each extending from a respective side of the adjustment tab 40.

When the machining module 35 pivots about the axis A5, one of the studs of the finger 41 slides along a circularly-arcuate guide groove 42 made in the connection piece 43. This guide groove 42 serves to stiffen the pivoting connection between the shaft and the bushing of the machining module 35 about the axis A5. It extends over a limited angular sector, typically lying in the range 15 degrees to 40 degrees, and in this example it is about 30 degrees. The machining module 35 can thus take up a plurality of angular positions about the axis A5 that are limited between two extreme angular positions. The machining module 35 is shown in FIG. 2 in one of these two extreme angular positions, and in FIG. 4 in the other one of the angular positions.

As shown more particularly in FIG. 5, said means for actuating the machining module 35 include an adjustment fork 44 suitable for co-operating with the other stud of the finger 41. This adjustment fork 44 comprises a base 45 fastened to the frame 3 of the grinder 2, and two tines 46, 47. Each tine 46, 47 possesses an inside face 48, 49 facing the other tine and extending substantially vertically in a plane parallel to the swivel axis A5 and to the reproduction axis A3 (FIG. 1). More precisely, these inside faces 48, 49 of the tines 46, 47 present two distinct functional zones:

- a top engagement zone for docking and engaging the finger 41, the top zones of the two tines together forming a centering funnel for the finger 41, enabling it to be guided in the event of it not being properly centered relative to the adjustment support 44, so as to be re-centered between the two tines 46 and 47; and
- an adjustment bottom zone serving initially to orient the machining module 35 accurately in a known and identified angular position about the axis A5, and subsequently to hold the finger 41 laterally while adjusting the orientation of the machining module 35 about the swivel axis A5.

This embodiment of the actuator means, that makes use of two tines co-operating with a finger, is not limiting. In a variant, provision can be made for other solutions that serve to adjust the orientation of the machining module, such as for example:

- replacing the tines with a cam; or
- replacing the finger of the adjustment tab by a gearwheel meshing with a wormscrew that is secured in translation relative to the frame of the grinder; position would then be held by the irreversible nature of the engagement between the gearwheel and the wormscrew.

The ability of the machining module 35 to swivel ORI is controlled by optimizing the degrees of freedom of movement in machining that already exist in the grinder 2.

In operation, these degrees of freedom that are available on the grinder 2 can be summarized as follows:

- rotation ROT of the lens, enabling the lens to be turned about its blocking axis A1, extending essentially normal to the general plane of the lens;
- reproduction RES, consisting in relative transverse movement between the lens (i.e. the general plane of the lens) and the shaping and beveling grindwheel 20, enabling the various radii describing the outline of the shape desired for the lens to be reproduced;
- transfer TRA, consisting in axial movement of the lens (i.e. perpendicularly to the general plane thereof) relative to the shaping and beveling grindwheel 20 and to the machining arm 30;
- retraction ESC, consisting in transverse movement of the machining arm 30 relative to the lens in a direction that is distinct from the reproduction direction, thereby enabling the machining arm 30 to be put into a utilization position and to be put into a storage position; and
- swiveling ORI of the machining module 35, consisting in pivoting movement of the machining module 35 about the swivel axis A5, so as to orient its machining tools correctly relative to the ophthalmic lens.

The first four above freedoms of movement are actuated by respective electromechanical means, while orientation adjustment ORI of the machining module 35 is performed by making use of the freedoms of movement in retraction ESC and transfer TRA.

To do this, the machining arm 30 is controlled to pivot about the transfer axis A2 (retraction ESC) to adopt a plurality of main angular positions, including:

- a storage position (as shown in FIG. 1), in which it is remote from the lens-holder shafts 11, 12, thereby releasing the space needed for machining the lens on the shaping and beveling grindwheel 20 without any risk of conflict; and
- a machining position, in which the selected machining tool is positioned between the shaping and beveling grindwheel 20 and the lens-holder shafts 11, 12, substantially vertically relative to the axis A2, or more generally on or close to the path (specifically a cylinder) followed by the axis A2 of the lens in its reproduction working stroke RES.

The machining arm 30 may also present an additional position in which it is very remote from the shafts 11, 12 so that the finger 41 of its adjustment tab 40 (FIG. 5) is engaged between the tines 46, 47 of the adjustment support 44.

Once engaged in this way, the machining arm 30 is moved in translation along the transfer axis A2 (transfer TRA) in such a manner that, with the finger being held laterally in the direction of the axis A2, the machining module 35 of the machining arm 30 moves relative to the finger 41 which remains stationary. This relative movement causes the finger 41 to slide along the guide groove 42. Controlling the movement in translation of the machining arm 30 along the transfer axis A2 thus serves to adjust the orientation of the machining module 35 about the axis A5.

The grinder 2 of the machining device 1 also includes means for spraying a liquid on the edge face of the lens that is blocked by the shafts 11 and 12 while the lens is being machined by one of the machining tools of the device. This liquid may be used for cooling or heating purposes. It serves to keep the ophthalmic lens at the temperature at which it is going to be used. More precisely, knowing that the future wearer of the lens lives in a country where the average temperature is known, the liquid maintains the temperature of the lens at said mean temperature while the lens is being machined. Consequently, when the lens is mounted in the rim of an eyeglass frame (advantageously made of metal), in the wearer's country, its dimensions correspond exactly to the intended dimensions and no expansion of the lens interferes with engagement.

With reference to FIG. 7, there follows a description more particularly of a machining technique making use of the third group of machining tools 98 for the purpose of finishing a lens 200 for a rimmed frame. This machining technique constitutes an improvement over the teaching of French patent application FR 06/07145 filed on Aug. 4, 2006.

The ophthalmic lens 200 possesses a front face 201 that is convex and a rear face 202 that is concave.

The finishing wheel 80 has a cylindrical working face 81 and a conical working face 82 with the normal at any point of this face being directed away from the center of curvature of the lens 200. The conical and cylindrical working faces 82 and 81 of this rigid finishing wheel 80 are used to form the rear flank 243 and the rear flat 224 of a peripheral engagement ridge 240, commonly referred to as bevel.

The polishing wheel 90 has a central cylindrical working face 91, and on either side of the cylindrical working face 91, it has two opposite conical working faces 92 and 93. The conical working faces 92 and 93 of this polishing wheel are used for making a polished chamfer on the edges of the front and rear faces of the lens. The central cylindrical working face 91 serves to polish the rear flat 224 of the peripheral engagement ridge 240 that extends parallel to the axis A2 between the rear flank 243 of the ridge and the rear face 202 of the lens. The normal to any point on one of the conical working faces 93 is directed towards the center of curvature of the lens 200. This conical working face 93 is thus appropriately oriented for machining the front face 201 of the lens, should that be necessary.

The peripheral portion 221 of the front face 201 of the lens is machined by the conical working face 93 of the polishing wheel 90 so as to present an inclined facet 241 that forms the front flank 241 of the peripheral ridge 240.

The freedoms of the lens to move in reproduction RES and in rotation ROT, and the freedom of the polishing wheel 90 to move in transfer TRA are controlled together by the electronic and computer device 100 so as to machine the peripheral portion 221 of the lens and thus form the machined front flank 241 of the peripheral ridge 240. This serves to form a second order discontinuity 242 on the peripheral portion 221 of the front face 201 of the lens. The peripheral portion 221 of the front face 201 of the lens is thus shaped to present a second order discontinuity, but with first order continuity with the remainder of the front face 201. The term first order continuity is used to mean that the shaped peripheral portion of the front face of the lens presents an edge in common with the non-shaped remainder of the front face. The term second order discontinuity is used to mean a discontinuity in the slope between the shaped peripheral portion of the front face of the lens and the non-shaped remainder of the front face. There is thus no step in the direction of the axis of the lens between the front face of the lens and the front flank of the engagement ridge.

The front flank 241 and the peripheral ridge 240 thus present a plane face that is suitable for coming into contact with the corresponding plane portion of a bezel of the rim of a frame (the groove going round the inside of a frame rim for rimmed eyeglasses). When the lens is mounted in the corresponding rim, the peripheral ridge of the lens is then engaged in the bezel of the rim in a manner that is more reliable and accurate. The conical front flank 141 of the peripheral ridge 140 is adapted to come appropriately into contact with the bezel. Furthermore, by machining the peripheral portion of the front face of the lens in this way, the lens is moved forward a little relative to the corresponding rim in which it is mounted, i.e. the lens is moved away from the eye, thereby improving the appearance of the frame.

The freedom of the machining module 35 to move in swiveling ORI may be controlled so as to obtain the desired angle of inclination for the front face 241 of the peripheral ridge on the lens 200.

The invention claimed is:

1. A device for machining an ophthalmic lens, the device comprising:

means (11, 12) for supporting the ophthalmic lens and for driving the ophthalmic lens in rotation about a blocking axis (A1), a machining module (35) that can be swiveled about a swivel axis (A5) relative to the means (11, 12) for supporting and driving the lens in rotation, said swivel axis (A5) being not parallel to the blocking axis (A1) of the lens, and at least one drilling tool (50) mounted to rotate on said machining module (35) about a first axis of rotation (A6), the device being characterized in that it includes:

at least one grooving and/or grinding tool (60, 70) mounted to rotate on said machining module (35) about a second axis of rotation (A7) distinct from and stationary relative to the first axis of rotation (A6), and a motor and gearbox assembly (38, 39) having a single motor (38) and adapted to drive said grooving and/or grinding tool (60, 70) and said drilling tool (50) at different speeds of rotation.

2. A device according to claim 1, wherein the distance between said swivel axis (A5) and said first axis of rotation (A6) is less than 40 millimeters.

3. A device according to claim 1, wherein the machining device (1) includes a shaping grindwheel (20) mounted to rotate about a transfer axis (A2), the direction of the blocking axis (A1) is stationary relative to the transfer axis (A2), and the direction of the machining module (35) is variable relative to the transfer axis (A2).

4. A device according to claim 1, wherein the axes of rotation (A6, A7) of the grooving and/or grinding tool and of the drilling tool (50, 60, 70) of the machining module (35) are parallel.

5. A device according to claim 1, wherein the machining module (35) is free to move transversely (ESC) relative to the blocking axis (A1), and is free to move axially (TRA) in translation along a transfer axis (A2) parallel to said blocking axis (A1) relative to the means (11, 12) for supporting the lens and driving it in rotation.

6. A device according to claim 5, including a support (31) on which said machining module (35) is mounted to pivot about the swivel axis (A5) and which is adapted to move in translation along said transfer axis (A2) relative to the means (11, 12) for supporting the lens and driving it in rotation, and to pivot about said transfer axis (A2) to provide the machining module (35) with its freedoms to move transversely (ESC) and axially (TRA).

7. A device according to claim 5, including actuator means (40, 44) that are engageable for actuating the machining module (35) or disengageable, which actuator means are arranged to adjust the orientation (ORI) of the machining module (35) about the swivel axis (A5) by making use of the freedom of the machining module (35) to move axially (TRA) relative to the means (11, 12) for supporting the lens and driving it in rotation, and which actuator means are engageable and disengageable by making use of the freedom of the machining module (35) to move transversely (ESC) relative to the blocking axis (A1).

8. A device according to claim 1, wherein the machining module (35) includes no more than two machining tools (50, 60, 70, 80, 90) mounted to rotate about a common axis of rotation (A6, A7, A8).

9. A device according to claim 1, wherein the drilling tool (50) is the only machining tool mounted to rotate about the first axis of rotation (A6) and is situated on an edge of the machining module (35) in such a manner that there exists at least one position of the machining module (35) in which the spacing between the first axis of rotation (A6) and the blocking axis (A1) is less than the sum of the radius of the grooving or grinding tool (60, 70) plus the radius of the means (11, 12) for supporting the lens and for driving it in rotation.

10. A device according to claim 1, wherein the machining module (35) includes a grooving wheel (60) and a milling tool (70) of diameter smaller than one centimeter mounted to rotate about a common axis of rotation (A7).

11. A device according to claim 1, wherein the machining module (35) includes a rigid finishing wheel (80) and a flexible polishing wheel (90) mounted to rotate about a common axis of rotation (A8).

12. A device according to claim 2, wherein the machining device (1) includes a shaping grindwheel (20) mounted to rotate about a transfer axis (A2), the direction of the blocking axis (A1) is stationary relative to the transfer axis (A2), and the direction of the machining module (35) is variable relative to the transfer axis (A2).

13. A device according to claim 2, wherein the axes of rotation (A6, A7) of the grooving and/or grinding tool and of the drilling tool (50, 60, 70) of the machining module (35) are parallel.

14. A device according to claim 3, wherein the axes of rotation (A6, A7) of the grooving and/or grinding tool and of the drilling tool (50, 60, 70) of the machining module (35) are mutually parallel.

15. A device according to claim 2, wherein the machining module (35) is free to move transversely (ESC) relative to the blocking axis (A1), and is free to move axially (TRA) in translation along a transfer axis (A2) parallel to said blocking axis (A1) relative to the means (11, 12) for supporting the lens and driving it in rotation.

16. A device according to claim 3, wherein the machining module (35) is free to move transversely (ESC) relative to the blocking axis (A1), and is free to move axially (TRA) in translation along a transfer axis (A2) parallel to said blocking axis (A1) relative to the means (11, 12) for supporting the lens and driving it in rotation.

17. A device according to claim 4, wherein the machining module (35) is free to move transversely (ESC) relative to the blocking axis (A1), and is free to move axially (TRA) in translation along a transfer axis (A2) parallel to said blocking axis (A1) relative to the means (11, 12) for supporting the lens and driving it in rotation.

18. A device according to claim 6, including actuator means (40, 44) that are engageable for actuating the machining module (35) or disengageable, which actuator means are arranged to adjust the orientation (ORI) of the machining module (35) about the swivel axis (A5) by making use of the freedom of the machining module (35) to move axially (TRA) relative to the means (11, 12) for supporting the lens and driving it in rotation, and which actuator means are engageable and disengageable by making use of the freedom of the machining module (35) to move transversely (ESC) relative to the blocking axis (A1).

19. A device according to claim 2, wherein the machining module (35) includes no more than two machining tools (50, 60, 70, 80, 90) mounted to rotate about a common axis of rotation (A6, A7, A8).

20. A device according to claim 3, wherein the machining module (35) includes no more than two machining tools (50, 60, 70, 80, 90) mounted to rotate about a common axis of rotation (A6, A7, A8).

* * * * *